US011603701B2

(12) United States Patent
Bickel et al.

(10) Patent No.: US 11,603,701 B2
(45) Date of Patent: Mar. 14, 2023

(54) DOOR FOR MOBILE LIVING QUARTERS

(71) Applicant: Dexter Axle Company, Elkhart, IN (US)

(72) Inventors: Randy A. Bickel, Elkhart, IN (US); Grant J. Mikosz, Edwardsburg, MI (US)

(73) Assignee: Dexter Axle Company, Elkhart, IN (US)

( * ) Notice: Subject to any disclaimer, the term of this patent is extended or adjusted under 35 U.S.C. 154(b) by 144 days.

(21) Appl. No.: 17/147,032

(22) Filed: Jan. 12, 2021

(65) Prior Publication Data

US 2022/0220796 A1 Jul. 14, 2022

(51) Int. Cl.

| | |
|---|---|
| ***E06B 3/00*** | (2006.01) |
| ***E06B 3/16*** | (2006.01) |
| ***E06B 3/968*** | (2006.01) |
| ***E06B 9/52*** | (2006.01) |

(52) U.S. Cl.

CPC ..... *E06B 3/16* (2013.01); *E06B 3/9681* (2013.01); *E06B 9/52* (2013.01); *E05Y 2900/512* (2013.01); *E05Y 2900/531* (2013.01); *E06B 2009/527* (2013.01)

(58) Field of Classification Search

CPC . E06B 3/16; E06B 3/9681; E06B 9/52; E06B 2009/527; E06B 3/667; E06B 3/163; E06B 2003/166; E06B 3/9682; E05Y 2900/512; E05Y 2900/531; F16B 7/0416; Y10T 403/46

See application file for complete search history.

(56) References Cited

U.S. PATENT DOCUMENTS

| | | | | |
|---|---|---|---|---|
| 5,666,773 | A * | 9/1997 | Librande | E06B 3/9684 160/369 |
| 7,740,048 | B2 * | 6/2010 | Wilson | E06B 9/52 160/371 |
| 8,001,742 | B2 * | 8/2011 | Briese | E06B 3/6675 403/201 |
| 8,955,270 | B2 * | 2/2015 | Markham | E06B 3/66 52/204.595 |
| 9,631,423 | B2 * | 4/2017 | Hornung | E06B 9/52 |
| 10,837,226 | B2 * | 11/2020 | Jeffries | E06B 3/9624 |
| 11,129,491 | B2 * | 9/2021 | Park | A47J 31/4403 |
| 11,203,898 | B2 * | 12/2021 | Roberts | E06B 9/52 |
| 11,371,284 | B2 * | 6/2022 | Karolevitz | B60J 1/2011 |
| 2006/0112654 | A1 * | 6/2006 | Reichert | E06B 3/667 52/202 |
| 2013/0051902 | A1 * | 2/2013 | Kelley | B29C 66/72523 403/205 |

* cited by examiner

*Primary Examiner* — Chi Q Nguyen
(74) *Attorney, Agent, or Firm* — Botkin & Hall, LLP

(57) ABSTRACT

A door is assembled from a plurality of straight lengths of extrusion, with the lengths of extrusion mated with corners at the top and bottom. The top corners are curved and interference fit to terminal ends of the top and side extrusions. The top and side extrusions have an opening into a cavity. As assembled, a continuous screen groove extends through the corners from the top, bottom, and side extrusions. The door includes transverse extrusions having an enclosed cross-sectional profile that are affixed to the side extrusions with alignment ends. The bottom corners interference fit to terminal ends of bottom extrusions and side extrusions.

17 Claims, 9 Drawing Sheets

DOOR FOR MOBILE LIVING QUARTERS

BACKGROUND OF THE INVENTION

This present disclosure relates to RV, trailer, and mobile living quarters doors. Due to weight and size constraints, doors in these applications are different construction and materials compared to doors for permanent structures, such as houses and businesses. Doors for mobile living quarters are made from lightweight materials, such as aluminum and composites. Mobile living quarters also pose unique problems for entry doors, because they are mobile and have to tolerate travel while maintaining structural integrity. Travel causes shifting, vibration, and other movement not present in permanent structures. Present door designs use an aluminum extrusion that is bent to form a monolithic three sided shape with two top radiused corners. In the existing designs, the bending to form the corners frequently creates cracks and requires a softer temper of aluminum. Getting a predictable bend is difficult for several reasons. First, aluminum changes temper as it ages, meaning that extrusion stock that has been on the shelf for a while is more likely to crack when bent.

Further, to bend the extrusion, a mandrel must be inserted internally to the tube to prevent the tube from collapsing. This means that a tolerance internal to the tube must be maintained, and that tolerance is only important for the mandrel and not the product function or quality. The mandrel must have a close fit to the inside of the tube to properly bend, but too close of a fit means that the extrusion gets stuck or cannot be properly inserted to bend. This tolerance requirement increases the cost of raw materials. The bending process can generate a significant amount of scrap material from cracks, irregular bends, and nonparallel sides. Once formed, the extrusion is assembled with either self-drilling screws, which have the tendency of missing the intended hole, or pre-drilling the holes, which create shavings. These shavings damage the finish on the door frame and are an additional source of scrap and waste. An improved door design is needed.

SUMMARY OF THE INVENTION

The present disclosure describes a door that is formed from cut sections of extrusion and assembled without bending. By using unbent sections, higher strength materials are used that could not be used if the door was formed by bending. The door is made by assembling the cut pieces, along with corner connectors that fit into channels in the extrusion. The corner connectors are assembled with a structural core and decorative covers that match the outside profile of the extrusion to give the same appearance of a bent door frame. The corners are press-fit into the terminal ends of the cut sections of extrusion. The extrusion is open on one side, which allows holes to be punched instead of being drilled. The punching of holes in the unbent sections provides a more controlled hole location and eliminates shavings that scratch the finish. The door has transverse members and a bottom rail that provide additional support and structure for the frame. The transverse members are held in with snap fit guides that align the punched holes with holes in the transverse members to receive fasteners. The extrusions have a channel to retain a screen, along with an additional channel to hold a kick panel.

DESCRIPTION OF THE PREFERRED EMBODIMENT

Figure 1:
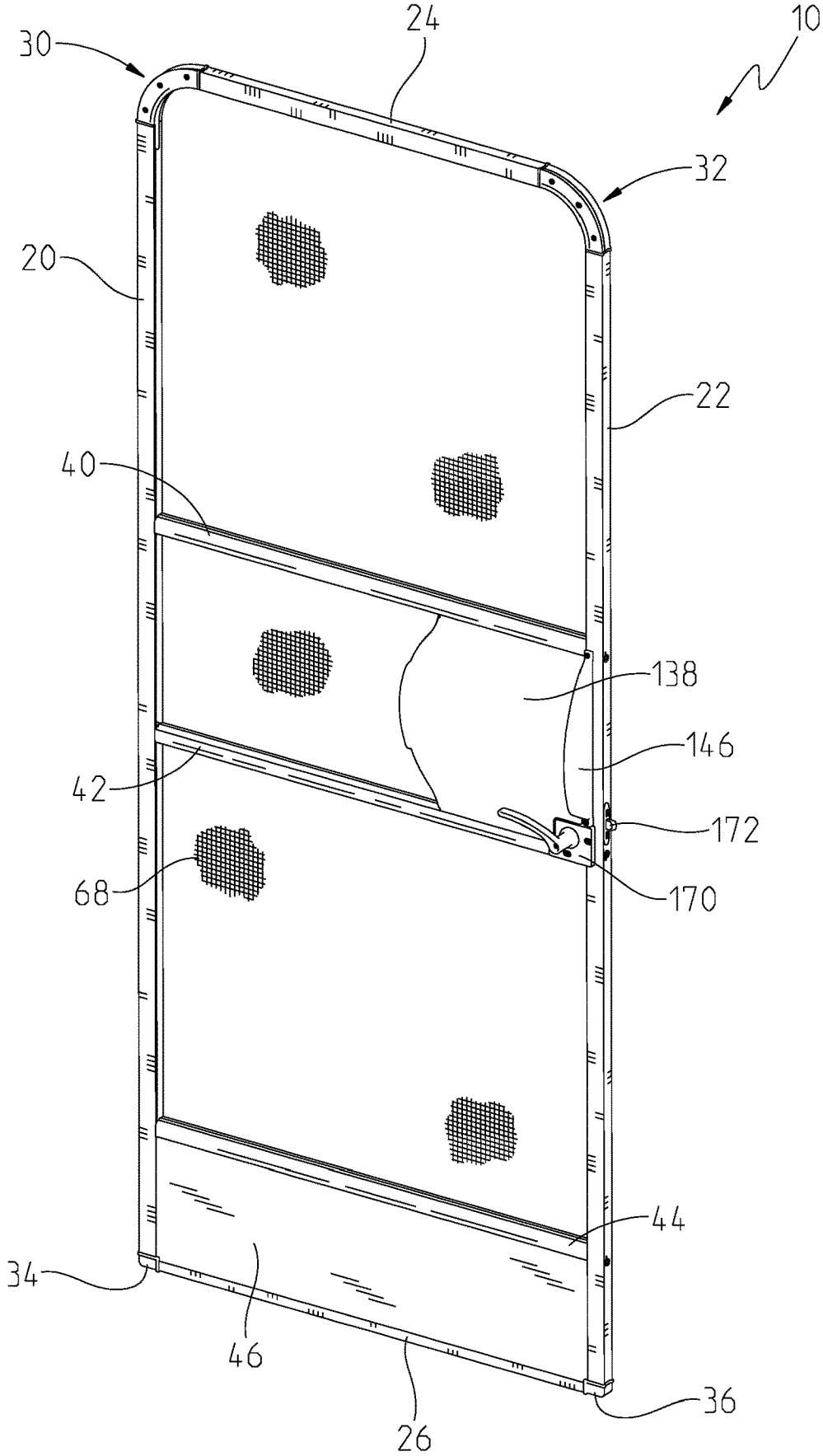
FIG. 1 is an isometric view of the door frame as assembled.

A door 10 is shown in FIG. 1 that is used with mobile living quarters (not shown). The door 10 is assembled from multiple components that include side rails 20, 22 a top rail 24, a bottom rail 26, top corners 30, 32, and bottom corners 34, 36. The rails and corners form a perimeter frame that is further reinforced with transverse members 40, 42, and 44.

Figure 3:
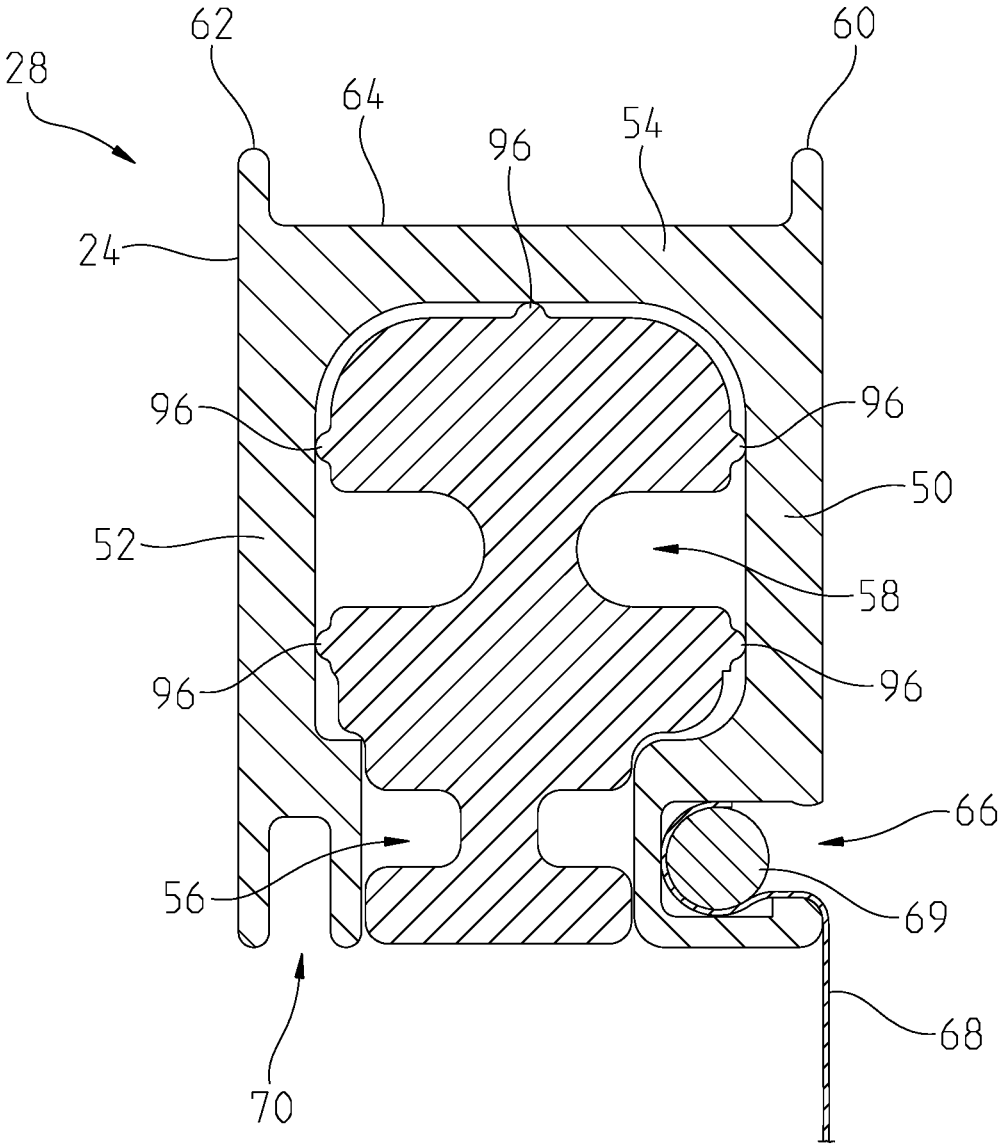
FIG. 3 is a section view 3-3 of the door frame in FIG. 2.

The side rails 20, 22 and top rail 24 share the same three-sided cross-sectional profile 28, shown in FIG. 3. Each of the rails 20, 22, 24 is a length of straight and unbent extrusion with terminal ends. The cross-section 28 has an outside facing wall 50, an inside facing wall 52, and a bridge wall 54. The bridge wall 54 connects the other walls 50, 52 and leaves an opening 56 into a cavity 58. The cavity 58 is wider than the opening 56. The profile 28 includes protrusions 60, 62 that extend in a direction parallel to the outside and inside facing walls 50, 52. The protrusions 60, 62 extend beyond the bridge wall surface 64 and provide a recessed area for a fastener. At the end of the outside facing wall 50 is a screen groove 66 that is used to hold a screen 68 and cord 69. The screen groove 66 has an opening that is narrower to retain the screen and cord. At the end of the inside facing wall 52 is a panel channel 70 that faces the same direction as the opening 56. The panel channel 70 and screen groove 66 are located on their respective walls opposite where the walls connect to the bridge wall 54.

Figure 2:
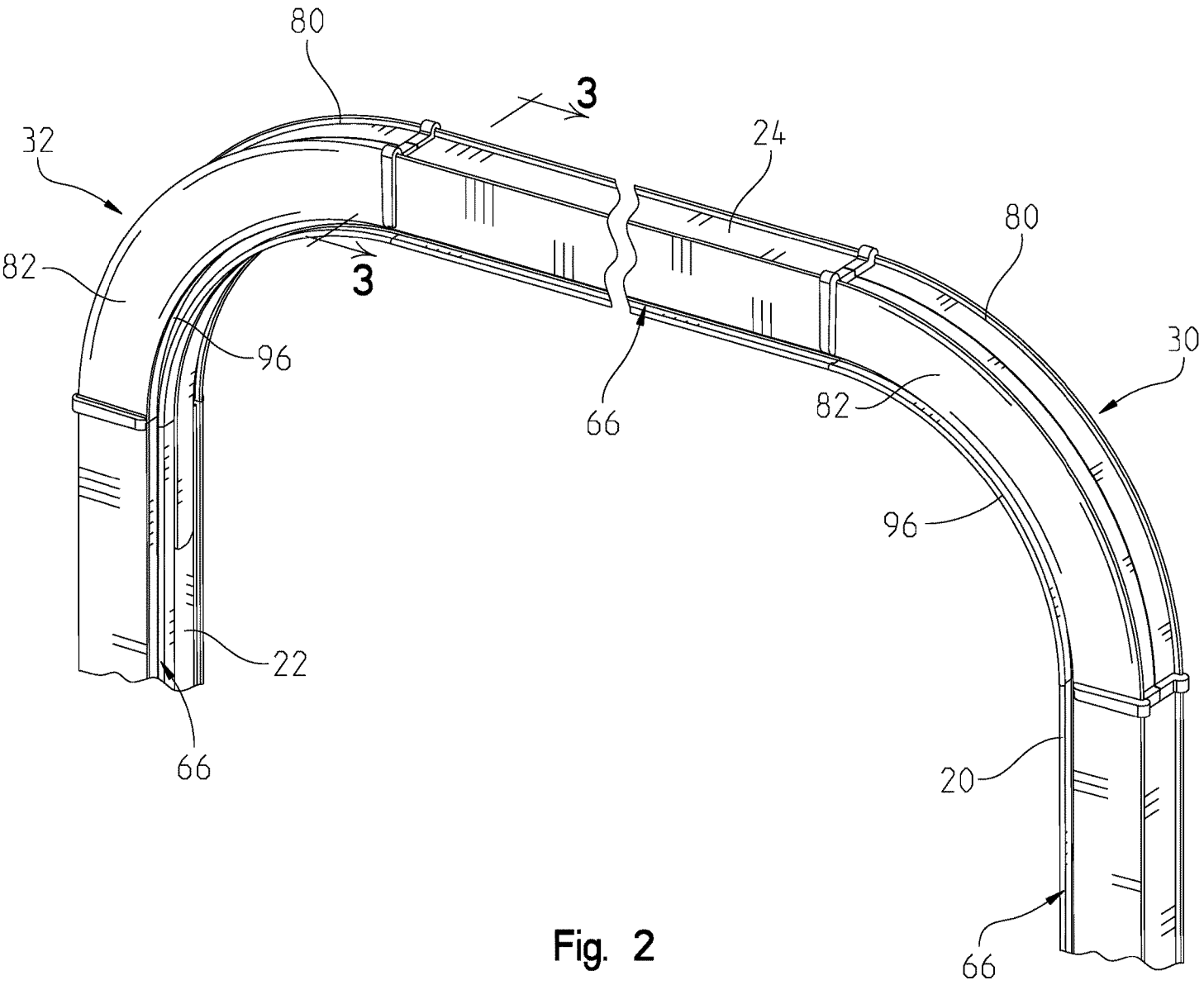
FIG. 2 is a partial view of the top corners of the door frame in FIG. 1.
Figure 4:
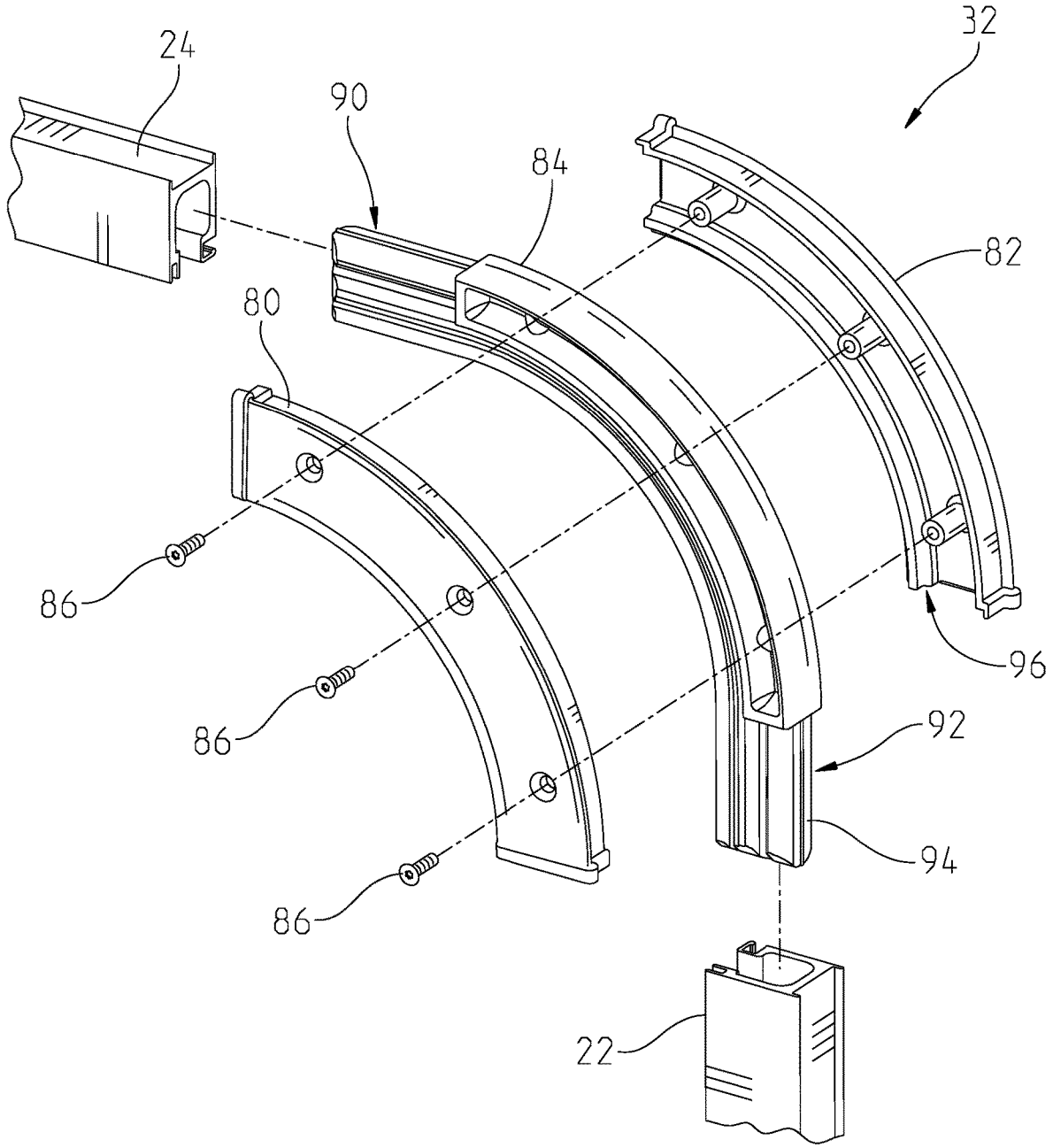
FIG. 4 is an exploded view of the top corner in FIG. 1.

The top corners 30, 32 are a gentle curve that is intended to match the look of the prior art bent frames with an outer radius around 3-4 inches and an inner radius of 2-3 inches. The curvature of the top corners 30, 32 is not limited by the radius specified. The top corners 30, 32 are identical and are only differentiated by their location on the door 10. Due to the identical nature of the corners 30, 32, just one of the top corners 30, 32 will be discussed in detail. Top corner 32 is shown exploded in FIG. 4, with an inner cover 80, an outer cover 82, and a core 84. The components are held together with fasteners 86. The core 84 is made from structural materials, which may not have a desirable surface finish, such as an engineered resin or glass-filled plastic. The covers 80, 82 provide a decorative surface that overlays most of the core 84. The covers 80, 82 can be molded out of different color materials to match the rails 20, 22, and 24. The inner cover 80 has holes and the outer cover 82 has complementary pockets to receive the threaded portions of the fasteners 86. As assembled, the corner 32 has pegs 90, 92 with a profile that is complementary to the opening 56 and cavity 58. As shown in FIG. 4, the pegs 90, 92 are 90° with respect to each other and separated by an arcuate or curved portion, made up by the covers 80, 82 and core 84. In addition, the pegs 90, 92 include interference ribs 94 to create a tight fit when the corners are mated to their corresponding rails 20, 22, 24. The outer cover 82 includes a screen groove 96 that aligns with the screen groove 66 in the rails 20, 22, 24 so that when the door 10 is assembled, the screen groove effectively continues through the corners. This is shown in FIG. 2.

Figure 6:
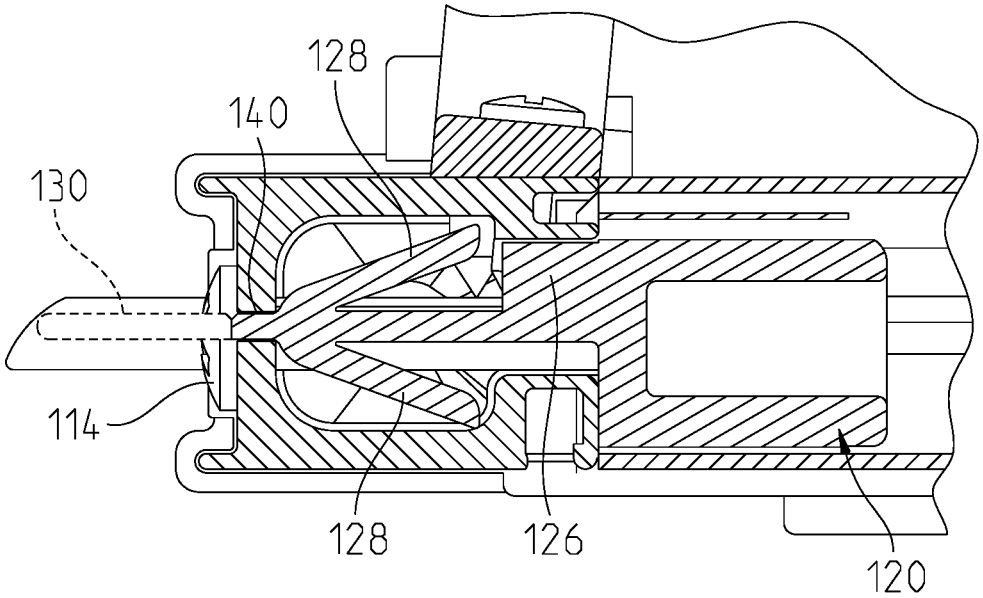
FIG. 6 is a section view 6-6 of the door frame in FIG. 5.
Figure 7:
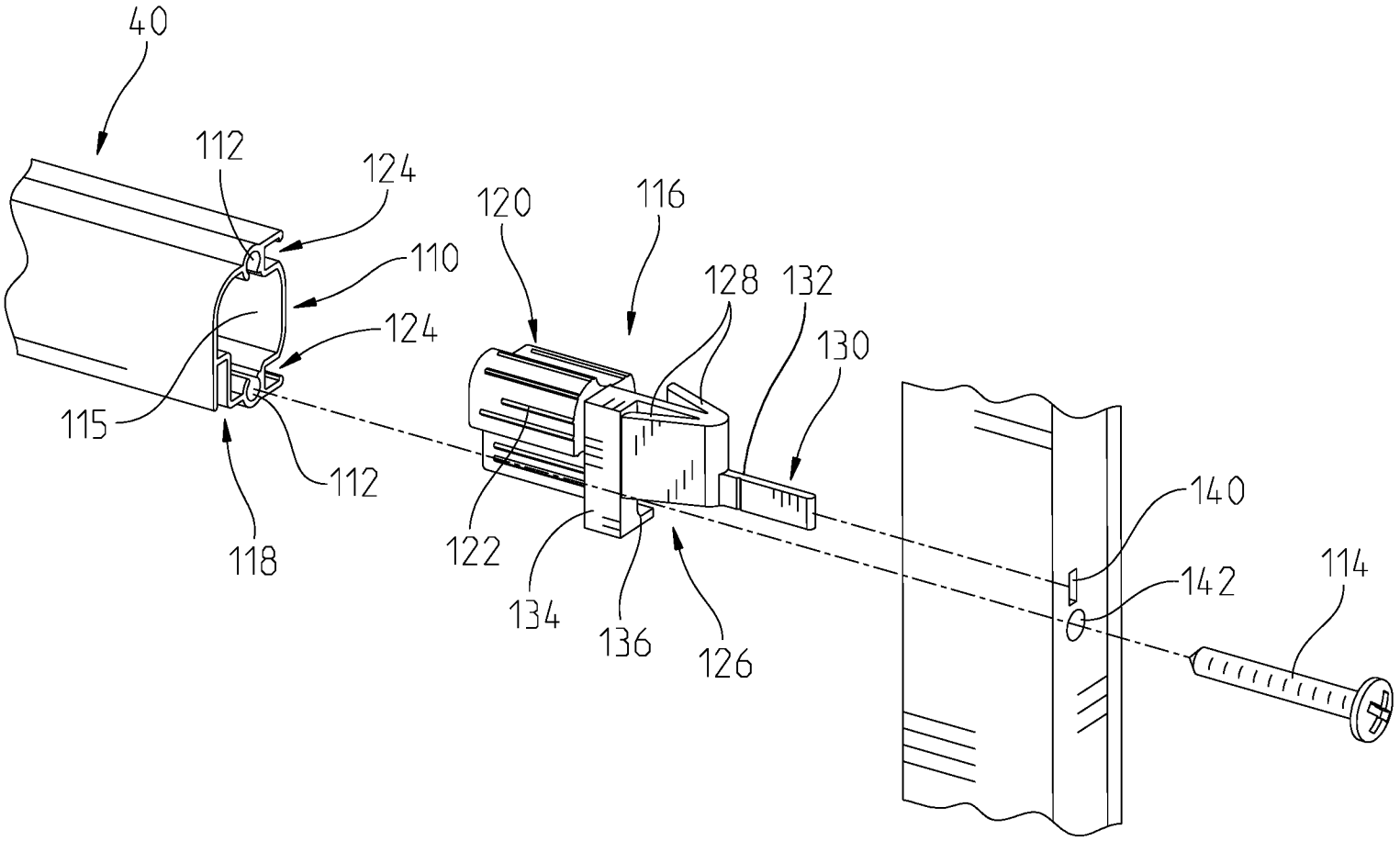
FIG. 7 is a partial exploded view of one of the connections between the transverse members and a side rail.
Figure 8:
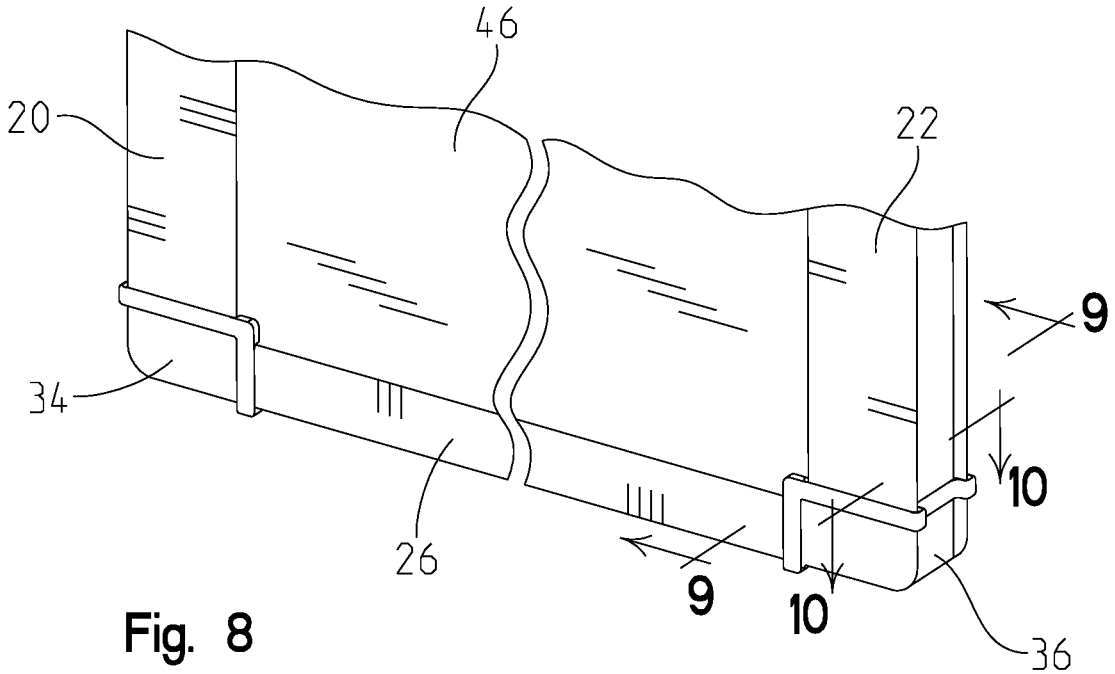
FIG. 8 is a partial view of the bottom of the door in FIG. 1.

The transverse members 40, 42, 44 are formed from a second profile of extrusion 110, shown in FIG. 7. Unlike the extrusion 28, the extrusion 110 is tubular with untapped holes 112 for fasteners 114 that locate and secure alignment ends 116 between the transverse members 40, 42, 44 and side rails 20, 22. The extrusion 110 has an interior shape 115 on the inside and screen grooves 124 on the outside that receive the screen 68 and cord 69. The screen grooves 124 are adjacent the untapped holes 112. The untapped holes 112 are smooth and the fasteners 114 cut their own threads when driven into the corresponding untapped hole 112. The untapped holes 112 as shown are not completely enclosed but are sufficiently enclosed to retain the fastener 114. One of the alignment ends 116 are shown in the installed state in FIG. 6, and as an exploded view in FIG. 7. As shown, alignment end 116 has three main portions, a transverse member portion 120, a side rail mating portion 126, and an alignment tab 130. The transverse member portion 120 is complementary to the interior shape 115 and has interference ribs 122 that mate with the extrusion 110. The fit between the transverse member portion 120 and interior shape 115 is interference and typically requires force to install. The alignment end 116 includes a side rail mating portion 126. The side rail mating portion 126 is designed to be inserted into the opening 56 and cavity 58, with spring tabs 128 that move inwardly when passing through the opening, but then spring outwardly once in the cavity 58 to retain the alignment end 116 to the corresponding side rail 20, 22. The alignment tab 130 overlaps with the head of the fastener 114 to provide a process reminder to the installer to break off the alignment tab 130 before the fastener 114 can be fully installed. This is shown in FIG. 6. The alignment tab 130 has a weakened area 132 that lands right where it protrudes through the bridge wall surface 64 and is designed to break off after installation to the corresponding side rail 20, 22. The side rail mating portion 126 has an anti-rotation block 134 that is sized to fit in the opening 56. The anti-rotation block 134 includes a fastener guide 136. The fastener guide 136 is three sided and cooperates with the opening 56 to surround the fastener. The fastener guide 136 prevents the fastener 114 from missing the untapped hole 112 in the extrusion 110 during assembly.

Figure 5:
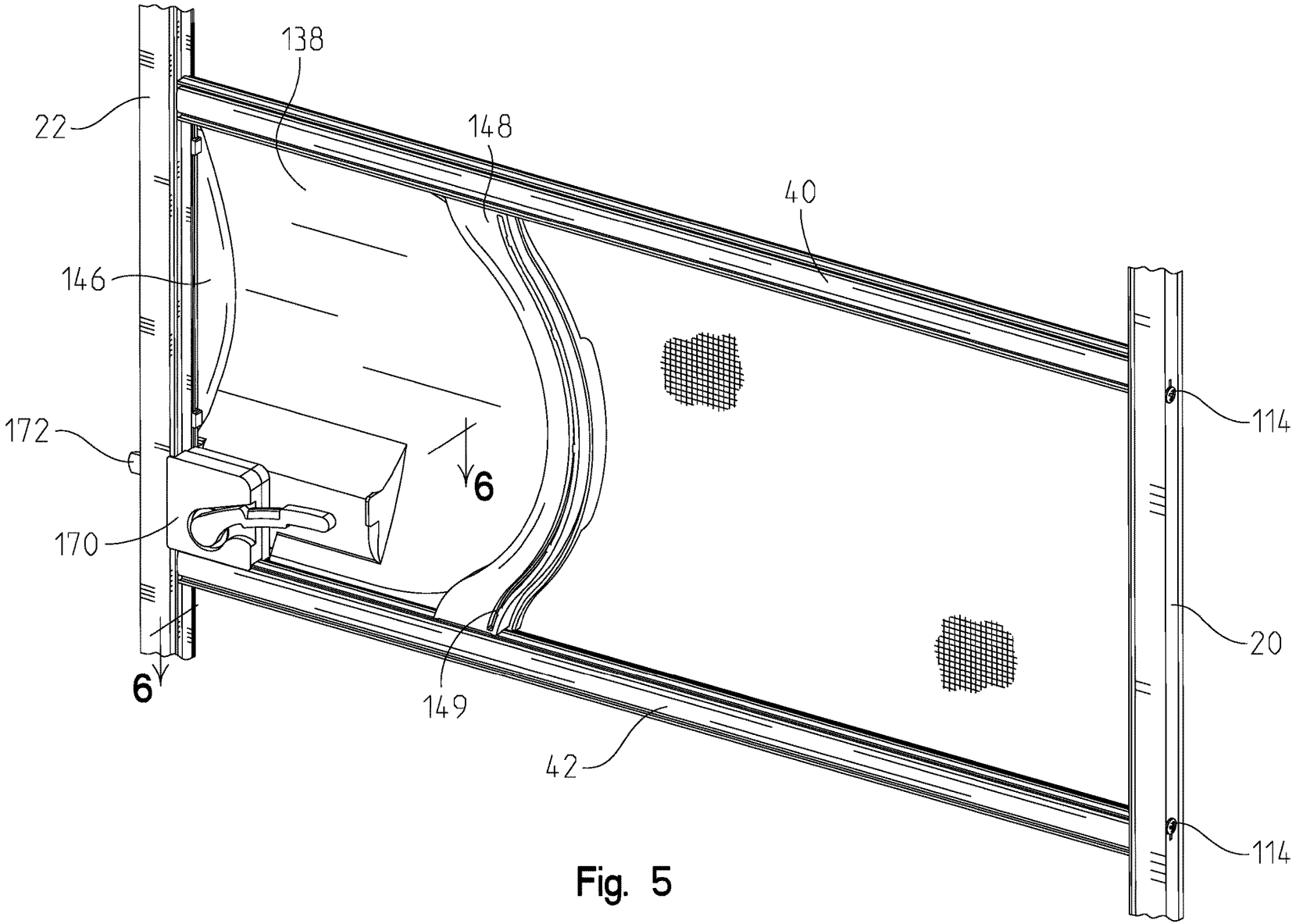
FIG. 5 is a partial isometric view of the latch portion of the door.

As assembled, the transverse members 40, 42 provide a guide for a sliding cover 138. The sliding cover 138 is retained in the transverse channels 118 and can slide between an opened position and a closed position, the closed position being shown in FIGS. 1 and 5. The transverse channel 118 faces downwardly in the upper transverse member 40, shown in FIG. 7, and upwardly in the lower transverse member 42. Other parts that work with the sliding cover 138 are a jamb 146 and a mid-jamb 148. The jamb 146 is affixed to the side rail 22, shown in FIG. 1. In the opened position, the sliding cover 138 is moved away from the jamb 146. The mid-jamb 148 is affixed between the transverse members 40, 42, as shown in FIG. 5. The mid-jamb 148 is held in place on the transverse members 40, 42 either through fasteners, pins fitting into predrilled pockets on the members 40, 42, or other fastening methods. The mid-jamb 148 includes a screen groove 149 for the area between the mid-jamb 148, side rail 20, and transverse members 40, 42.

Figure 9:
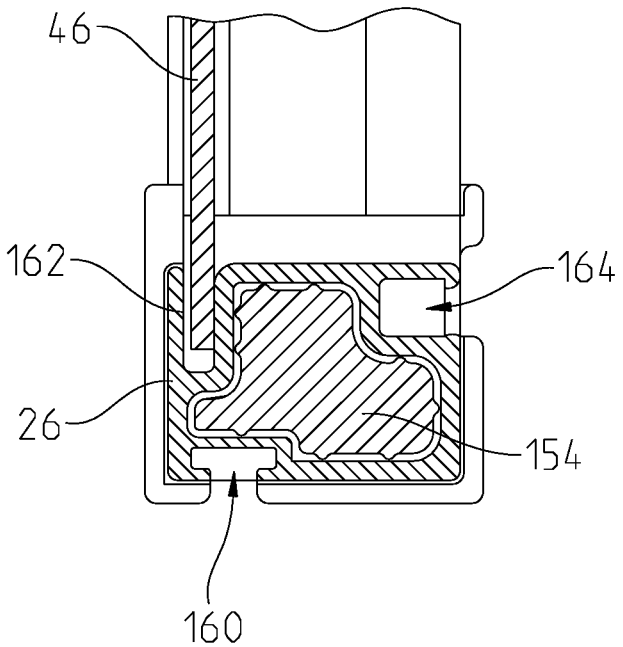
FIG. 9 is a section view 9-9 of the door frame as shown in FIG. 8.
Figure 10:
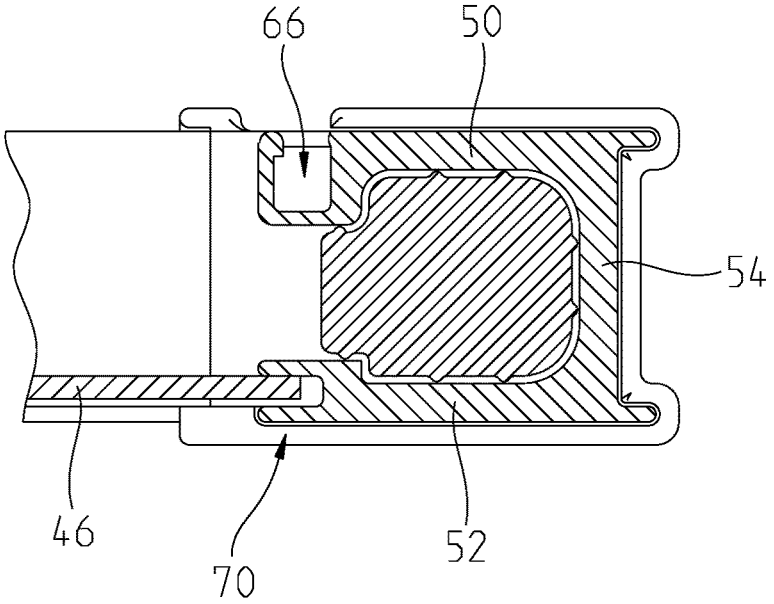
FIG. 10 is a section view 10-10 of the door frame as shown in FIG. 8.
Figure 11:
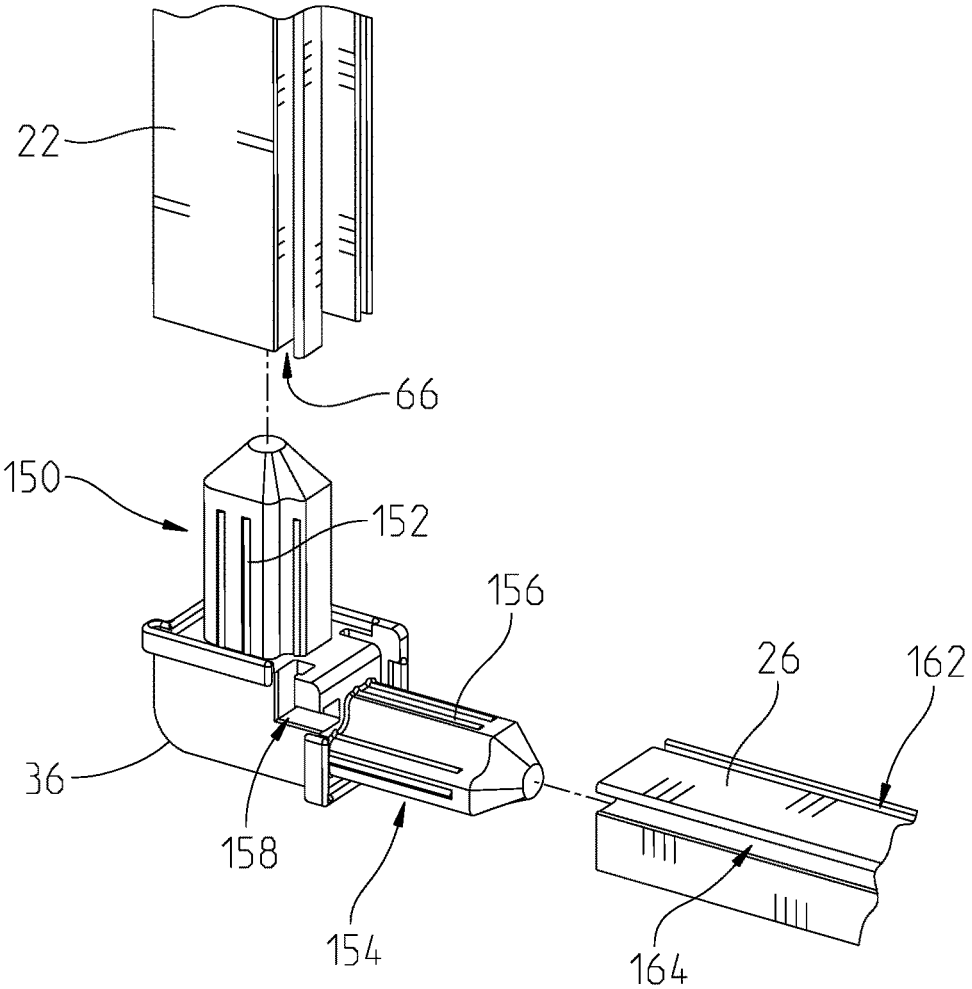
FIG. 11 is a partial exploded view of one of the bottom corners as shown in FIG. 8.

The bottom rail 26 is held between the side rails 20, 22 by the bottom corners 34, 36. The bottom corners 34, 36 are mirror symmetrical with a side rail peg 150 having interference ribs 152 that create a tight fit when inserted into a side rail 20, 22. The bottom rail 26 is different from the other extrusions, shown in FIG. 9. There is a T-shaped wiper groove 160 to receive a common felt or resilient seal (not shown) and a screen groove 164 that can receive a screen and cord for some applications that may not use a panel 46. The bottom rail 26 also includes a panel slot 162 that is aligned with the panel channel 70 as assembled and receives the panel 46. The bottom corners 34, 36 include a bottom rail peg 154 with interference ribs 156 for a snug fit to the bottom rail 26 when assembled thereto. The corners 34, 36 include a screen groove 158 that aligns with screen groove 164 on the bottom rail 26 and the screen groove 66 on the corresponding side rail 20, 22. As assembled, the screen grooves 96, 66, 158, and 164 align to form a continuous channel.

The latch 170 is secured to the lower transverse member 42 and the side rail 22 with fasteners and has a bolt 172 that extends through holes in the side rail 22 to mate and latch to a door frame (not shown).

To manufacture the door 10, the following steps are performed. The extrusions are cut to length with simple and straight cuts. The extrusion for the transverse members 40, 42, 44 and bottom rail 26 are cut to length. The extrusion for the side rails 20, 22 and top rail 24 are cut to length with simple and straight cuts. Separately, the pieces that make the corners 30, 32 are molded, along with the alignment ends 116 and bottom corners 34, 36. To locate the installation of the transverse members 40, 42, 44, holes 140, 142 are punched at specific locations along the length of the side rails 20, 22 through the bridge wall 54. Hole 140 is a narrow slot that will receive the alignment tab 130, and the hole 142 is for the fastener 114. The corners 30, 32 are assembled with the fasteners 86 holding the covers 80, 82 to the core 84. The panel 46 is cut to size and all of the components are assembled. Once the door 10 is assembled, the screen 68 is installed and other hardware is located and installed.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A door for use in mobile living quarters, said door having frame formed without bending, said door comprising:

a top rail having first terminal ends;

a hinge side rail having second terminal ends, a hinge side top radiused corner connecting one of said first terminal ends to one of said second terminal ends;

a latch side rail having third terminal ends, a latch side top radiused corner connecting the other of said first terminal ends to one of said third terminal ends;

said top rail, said hinge side rail, and said latch side rail having an identical first cross-section profile, said first cross-section profile having an outside facing wall, an inside facing wall substantially parallel to said outside facing wall, and a bridge wall connecting said outside facing wall to said inside facing wall, said walls forming an opening into a cavity, said opening being more narrow than said cavity;

transverse members having a second cross-section profile, said transverse members affixed between said latch side rail and said hinge side rail, one of said transverse members being an upper transverse member and the other of said transverse members being a lower transverse member; and alignment ends mated to fourth terminal ends of said transverse members, said alignment ends having a transverse member portion, an anti-rotation block portion, and a side rail mating portion, said side rail mating portion having spring tabs for being located in said cavity and a severable alignment tab for aligning a hole in said bridge wall to an untapped hole in said transverse member, said hole in said bridge wall and said untapped hole receiving a fastener to affix said transverse member to a corresponding said side rail.

2. The door in claim 1, further comprising a sliding cover retained by said transverse members and slidable between an open and a closed position, said closed position defined by said sliding cover in contact with a jamb, said opened position defined by said sliding cover spaced from said jamb.

3. The door in claim 1, wherein said outside facing wall has a screen groove.

4. The door in claim 1, wherein said inside facing wall has a panel channel has a panel slot, said panel opening adjacent said cavity.

5. The door in claim 1, wherein said first cross-section profile has protrusions extending outwardly in a direction parallel to said inside facing wall and said outside facing wall, said protrusions extending beyond a bridge wall surface on said bridge wall.

6. The door in claim 1, wherein said latch side and said top side radiused corners are identical, each said radiused corners having an outer cover affixed through a core to an outer cover, said core having pegs to press fit into said cavities of said side rails and said top rail.

7. The door in claim 1, wherein said radiused corners include a screen groove, said screen groove on said radiused corners aligned to said screen grooves in said side and top rails to form a continuous groove from said hinge side rail to said latch side rail.

8. The door in claim 1, wherein said fastener to affix said transverse member to said corresponding side rail has a head that partially overlaps said severable alignment tab to prevent said fastener from being installed without said severable alignment tab being removed.

9. The door in claim 1, further comprising a bottom rail affixed to said hinge side rail and said latch side rail with bottom corners, said bottom corners having a side rail peg and a bottom rail peg, said side rail peg for being received by one of said side rails, said bottom rail peg for being received by said bottom rail.

10. A screen door comprising:

a first extrusion having an inside facing wall connected to a bridge wall connected to an outside facing wall to form a three-sided profile shape, said outside facing wall being parallel to said inside facing wall, said first extrusion having an pening to a cavity, said opening being located opposite said bridge wall and more narrow than said cavity, said first extrusion having a first screen groove;

a second extrusion being tubular with an enclosed interior shape, said second extrusion having an untapped hole adjacent a second screen groove, said second extrusion having a transverse channel located adjacent said untapped hole;

a top rail, a hinge side rail, and a latch side rail formed from straight lengths of said first extrusion;

a upper transverse member and lower transverse member formed from straight lengths of said second extrusion, said upper transverse member affixed between said hinge side rail and said latch side rail and parallel to said top rail, said lower transverse member affixed between said hinge side rail and said latch side rail and parallel to said upper transverse member;

an alignment end having a transverse member portion for mating to a terminal end of said transverse members, an anti-rotation block portion, and a side rail mating portion, said side rail mating portion having spring tabs for being located in said opening and a severable alignment tab for aligning a hole in said bridge wall to an untapped hole in said transverse member, said hole in said bridge wall and said untapped hole receiving a fastener to affix said transverse member to a corresponding said side rail;

a top radiused corner having a curved portion located between orthogonally positioned pegs, said pegs sized to mate with said first extrusion, said top radiused corner having a corner screen groove aligned with said first screen groove; and said hinge side rail affixed to said top rail at a first said top radiused corner, said top rail affixed to said latch side rail at a second said top radiused corner.

11. The screen door in claim 10, further comprising a bottom rail affixed to said hinge side rail and said latch side rail with bottom corners, said bottom corners having a side rail peg and a bottom rail peg, said side rail peg for being received by one of said side rails, said bottom rail peg for being received by said bottom rail.

12. The screen door in claim 10, further comprising a sliding cover retained by said transverse channels in said transverse members and slidable between an open and a closed position, said closed position defined by said sliding cover in contact with a jamb, said opened position defined by said sliding cover spaced from said jamb.

13. A door comprising:

a frame assembled from a plurality of unbent extrusions and corners, one of said unbent extrusions being a top rail having first terminal ends, a second of said unbent extrusions being a hinge side rail having second terminal ends, a third of said unbent extrusions being a latch side rail having third terminal ends, a fourth of said unbent extrusions being a bottom rail having fifth terminal ends;

a hinge side radiused top corner having a first peg and a second peg, said first and second pegs connected by an arcuate portion, said second peg being orthogonally positioned with respect to said first peg;

a latch side radiused top corner being identical to said hinge side top corner;

said hinge side top corner connecting said second terminal ends to said first terminal ends, said latch side top corner connecting said third terminal ends to said first terminal ends;

a first bottom corner connecting one of said third terminal ends to one of said fifth terminal ends;

a second bottom corner connecting said hinge side rail to said bottom rail; and said radiused top corners, said bottom corners, and said rails each having a screen groove, said screen grooves connecting to form a continuous channel wherein said top rail and said side rails are formed from a profile having outside facing wall, an inside facing wall substantially parallel to said outside facing wall, and a bridge wall connecting said outside facing wall to said inside facing wall, said walls forming an opening into a cavity;

an upper transverse member and a lower transverse member, said transverse members affixed between said second terminal ends and said third terminal ends; and wherein said transverse members are affixed to said side rails with alignment ends, each said alignment ends having a transverse member portion for mating to a terminal end of said transverse members, an anti-rotation block portion, and a side rail mating portion, said side rail mating portion having spring tabs for being located in said opening and a severable alignment tab for aligning a punched hole in said bridge wall to an untapped hole in said transverse member, said punched hole in said bridge wall and said untapped hole receiving a fastener to affix said transverse member to a corresponding said side rail.

14. The door in claim 13, further comprising a sliding cover retained by transverse channels in said transverse members and slidable between an open and a closed position, said closed position defined by said sliding cover in contact with a jamb, said opened position defined by said sliding cover spaced from said jamb.

15. The door in claim 13, wherein said latch side and said top side radiused corners each having an outer cover affixed through a core, said core having pegs to press fit into said cavities of said side rails and said top rail.

16. The door in claim 13, further comprising an upper transverse member and a lower transverse member, said transverse members affixed between said second terminal ends and said third terminal ends.

17. The door in claim 16, wherein said upper and lower transverse members formed from a tubular extrusion with an enclosed interior shape, said tubular extrusion having an untapped hole adjacent a screen groove, said tubular extrusion having a transverse channel located adjacent said untapped hole.

* * * * *